US007891100B2

(12) United States Patent
Gelardi et al.

(10) Patent No.: US 7,891,100 B2
(45) Date of Patent: Feb. 22, 2011

(54) SYSTEM FOR OPENING AN ARTICLE ENCASEMENT

(75) Inventors: John A. Gelardi, Kennebunkport, ME (US); William R Rigby, Midlothian, VA (US)

(73) Assignee: MeadWestvaco Corporation, Richmond, VA (US)

( * ) Notice: Subject to any disclaimer, the term of this patent is extended or adjusted under 35 U.S.C. 154(b) by 852 days.

(21) Appl. No.: 11/619,540

(22) Filed: Jan. 3, 2007

(65) Prior Publication Data

US 2007/0164029 A1 Jul. 19, 2007

Related U.S. Application Data

(60) Provisional application No. 60/756,094, filed on Jan. 3, 2006.

(51) Int. Cl.
*B67B 7/00* (2006.01)
*B65D 83/04* (2006.01)

(52) U.S. Cl. ..... 30/294; 30/124; 30/278

(58) Field of Classification Search ..... 30/2, 30/124, 278, 289, 290, 294
See application file for complete search history.

(56) References Cited

U.S. PATENT DOCUMENTS 1,452,341 A 4/1923 Jacquemin
2,291,294 A 7/1942 Holste
2,386,416 A 10/1945 Wilhelm
2,473,492 A 6/1949 Shina
2,497,455 A 2/1950 Johnson
2,664,091 A * 12/1953 Thostenson ..... 206/238
3,001,284 A 9/1961 Marotz
3,002,668 A 10/1961 Castelli
3,118,228 A 1/1964 Adams
3,142,426 A * 7/1964 Busse ..... 225/43
3,175,746 A 3/1965 Porter et al.
3,217,954 A 11/1965 Grant
3,380,159 A 4/1968 Winston
3,517,871 A 6/1970 Gaffney et al.
3,619,902 A 11/1971 Fleury
3,721,382 A 3/1973 Cavanagh et al.
3,993,190 A 11/1976 Schmidgall
4,015,717 A 4/1977 Richardson et al.
4,126,263 A 11/1978 Martensson
4,144,985 A 3/1979 Kinslow
4,159,568 A 7/1979 Berner
4,173,826 A 11/1979 Leopoldi et al.
4,179,806 A 12/1979 Lieptz
4,231,477 A 11/1980 DeFelice (Continued)

FOREIGN PATENT DOCUMENTS

DE 2822100 11/1979

(Continued)

*Primary Examiner*—Hwei-Siu C Payer
(74) *Attorney, Agent, or Firm*—MWV Intellectual Property Group

(57) ABSTRACT

A system for opening encased articles has a cutting apparatus that includes a channel formed from spaced-apart parallel walls. A cutting member having a cutting edge extends from one wall into the channel. A protrusion disposed in the channel at least partially overlaps and at least partially obstructs the cutting member. The channel is adapted for receiving the flanged edge of the article and the protrusion is displaceable to expose the cutting edge of the cutting member. A system further has the cutting apparatus juxtaposed with a container for storing at least one encased article.

18 Claims, 5 Drawing Sheets

U.S. PATENT DOCUMENTS

| | | | | | |
|---|---|---|---|---|---|
| 4,384,649 | A | | 5/1983 | Brodsky | |
| 4,457,427 | A | | 7/1984 | Cafiero | |
| 4,530,154 | A | | 7/1985 | DiCarlo | |
| 4,694,996 | A | | 9/1987 | Siegel | |
| 4,697,344 | A | | 10/1987 | Leopoldi | |
| 4,706,875 | A | | 11/1987 | Blackman | |
| 4,711,031 | A | * | 12/1987 | Annello | 30/294 |
| 4,778,054 | A | | 10/1988 | Newell et al. | |
| 4,873,767 | A | | 10/1989 | Lok | |
| 4,887,755 | A | | 12/1989 | Gibilisco | |
| 4,905,866 | A | | 3/1990 | Bartell et al. | |
| 4,909,395 | A | | 3/1990 | Weissman | |
| 4,998,623 | A | | 3/1991 | Doull | |
| 5,007,171 | A | * | 4/1991 | Horning, Jr. | 30/294 |
| 5,014,431 | A | | 5/1991 | Jebe et al. | |
| 5,019,125 | A | | 5/1991 | Rebne et al. | |
| 5,038,475 | A | | 8/1991 | Wolff | |
| 5,103,562 | A | * | 4/1992 | Braatz | 30/294 |
| 5,109,984 | A | | 5/1992 | Romick | |
| 5,118,021 | A | | 6/1992 | Fiocchi | |
| 5,127,161 | A | | 7/1992 | Ikeda | |
| 5,285,575 | A | | 2/1994 | Hirano | |
| 5,332,096 | A | | 7/1994 | Battaglia | |
| 5,348,158 | A | | 9/1994 | Honan et al. | |
| 5,356,010 | A | * | 10/1994 | Weinstein | 206/532 |
| 5,431,283 | A | | 7/1995 | Weinstein et al. | |
| 5,666,731 | A | | 9/1997 | Rungren | |
| 5,752,319 | A | | 5/1998 | Su et al. | |
| 5,816,404 | A | | 10/1998 | Seidler | |
| 5,853,101 | A | | 12/1998 | Weinstein | |
| 5,909,822 | A | | 6/1999 | George et al. | |
| 6,145,722 | A | | 11/2000 | Behrens et al. | |
| 6,557,945 | B1 | | 5/2003 | Eric | |
| 6,658,742 | B2 | * | 12/2003 | Votolato | 30/280 |
| RE40,756 | E | * | 6/2009 | Hall | 24/501 |
| 2003/0029880 | A1 | | 2/2003 | Hunts | |
| 2004/0129123 | A1 | | 7/2004 | Miller | |
| 2006/0138017 | A1 | * | 6/2006 | Gelardi | 206/532 |

FOREIGN PATENT DOCUMENTS

| | | |
|---|---|---|
| EP | 0179743 | 1/1991 |
| GB | 467606 | 6/1937 |

* cited by examiner 320
326
331
314
336
338
330
318
316
324
322
328
312
340

SYSTEM FOR OPENING AN ARTICLE ENCASEMENT

RELATED APPLICATIONS

This application claims priority to U.S. Application No. 60/756,094, filed Jan. 3, 2006, the entirety of which is incorporated herein by reference.

TECHNICAL FIELD

The invention relates to the packaging of encased articles such as those wrapped in a protective seal and, more specifically, to a system for storing and opening encased articles.

BACKGROUND OF THE INVENTION

A blister pack is a type of package wherein items or articles to be protected are sealed between a substantially planar substrate and at least one concave compartment structure called a blister. Several terms in the art of blister-type packaging have interchangeable meanings and definitions; therefore, the following naming convention will be used herein for clarity. The term "blister" is used herein to refer to the bubble of plastic or similar material that forms the actual protective encasement for an item or article. The terms "unit dose blister" and "unit dose blister encasement" are used herein to refer to the packaging formed by a single blister bubble and its associated substrate backing. A unit dose blister encasement typically has at least one flanged edge, and, more typically a flanged perimeter. The term "blister pack" is used herein to refer to an aggregate of multiple unit dose blister encasements.

The blister (that is, the bubble) is typically made of a plastic type material. The substrate may be paper, foil, plastic, or a laminate of one or more of these materials. The encased item or article is typically removed by pushing the article or item from the blister side of the pack through the planar substrate. In the case of a child-resistant package, both the substrate and the blister are made so as to be difficult to penetrate.

The unit dose blister encasement is useful for packaging an individual, or a unit, dose of pharmaceutical products. When used for this purpose, the blister pack is particularly suitable for the packaging and distribution of multiple unit doses in a single package. A well known, typical blister pack is arranged as an array of individual, or unit, dose blister encasements. In some embodiments, a blister can store more than a single unit dose. Each blister in a blister pack is typically segregated by lines of demarcation. The intersecting lines of demarcation define individual unit dose blister encasements. The line of demarcation may be a frangible line, such as a perforated line, that facilitates separation of a unit dose blister encasement from the blister pack.

A problem with encased articles including those in unit dose blister encasements and pouches is that often it may be difficult to push the item, or article through the protective covering. This problem can exist because the blister substrate is made particularly durable to maintain the freshness and efficacy of the encased article, or the substrate can be made to inhibit removal of the encased article or item, as in the use of a child-resistant package. The same is true for pouches with a tough exterior and child-resistance rating. Thus, a need exists for a means for facilitating removal of an encased item or article from a blister, blister pack, pouch, or similar protective seal.

It is known to provide a cutting apparatus that employs a protruding blade to puncture a substrate. However, such blades are typically exposed and create a hazard for users. Other known cutting apparatuses are large, costly, and difficult to integrate into containers. Further, cutting apparatuses can typically be used for only one type of encased article.

Although prior attempts to solve the problem of removing an encased article from its protective seal are known, there remains the need for a convenient means to store encased articles together with a means for safely and efficiently cutting the unique protective seal that encases the article.

SUMMARY OF THE INVENTION

The various embodiments of the present invention overcome the shortcomings of the prior art by providing a system for opening encased articles. By way of example and not limitation, an encased article includes an item that is sealed by any flexible or semi-flexible protective covering, is shrink-wrapped, or is blister-wrapped.

According to one aspect of the invention, a cutting apparatus having a channel for receiving an encased article includes a cutting member disposed within the channel so as to engage the seal of the encased article as it is translated within the channel.

According to another aspect of the invention, a cutting apparatus having a channel for receiving an encased article is defined between two walls and a cutting member, disposed within the channel, is protected by a displaceable protrusion.

According to further aspects of the invention, a cutting apparatus is juxtaposed in various ways with a container for storing at least one unit dose encasement.

Other systems, methods, features, and advantages of the present invention will be or become apparent to one with skill in the art upon examination of the following drawings and detailed description. All such additional systems, methods, features, and advantages are included within the scope of the present teaching and are protected by the accompanying claims.

The foregoing has broadly outlined some of the aspects and features of the present invention, which should be construed to be merely illustrative of various potential applications of the invention. Other beneficial results can be obtained by applying the disclosed information in a different manner or by combining various aspects of the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION

Figure 1:
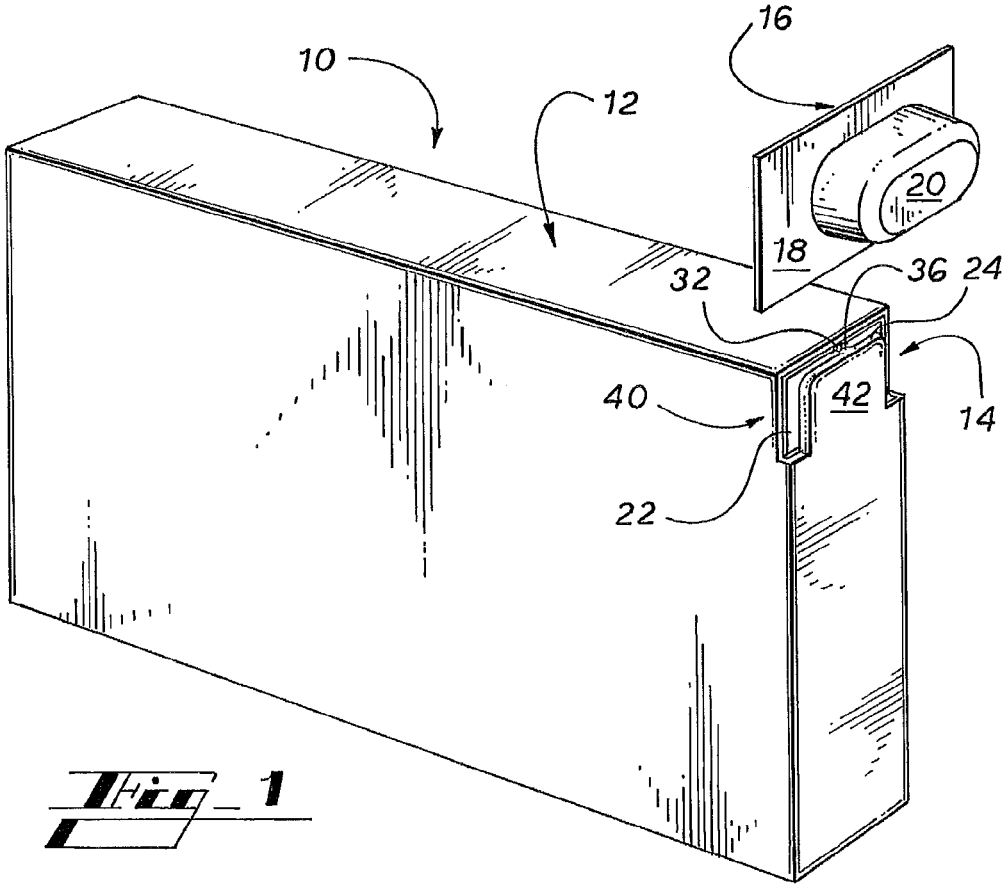
FIG. 1 is a perspective view of an exemplary embodiment of a system for opening unit dose blister encasements, according to the present invention.

As required, detailed embodiments of the present invention are disclosed herein. It must be understood that the disclosed embodiments are merely exemplary of the invention that may be embodied in various and alternative forms, and combinations thereof. As used herein, the word "exemplary" is used expansively to refer to embodiments that serve as an illustration, specimen, model or pattern. The figures are not necessarily to scale and some features may be exaggerated or minimized to show details of particular components. In other instances, well-known components, systems, materials, or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention.

Referring now to the drawings wherein like numerals indicate like elements throughout the several views, the drawings illustrate certain of the various aspects of exemplary embodiments of a system for opening an enclosed article including a container and a cutting apparatus. In the system, a cutting apparatus includes a cutting member disposed in a channel. The cutting apparatus is protected by a displaceable protrusion.

Referring first to FIG. 1, an exemplary embodiment of a system 10 for opening unit dose blister encasements is illustrated. The system 10 includes a container 12 and a cutting apparatus 14. Here, the cutting apparatus 14 is located within the container 12 and facilitates opening the seal of an encased article. In operation, the cutting apparatus 14 can cut a flanged portion 18 of a unit dose blister 16, such that the substrate can be separated from a blister bubble 20 to access an article within the blister 16.

Figure 2:
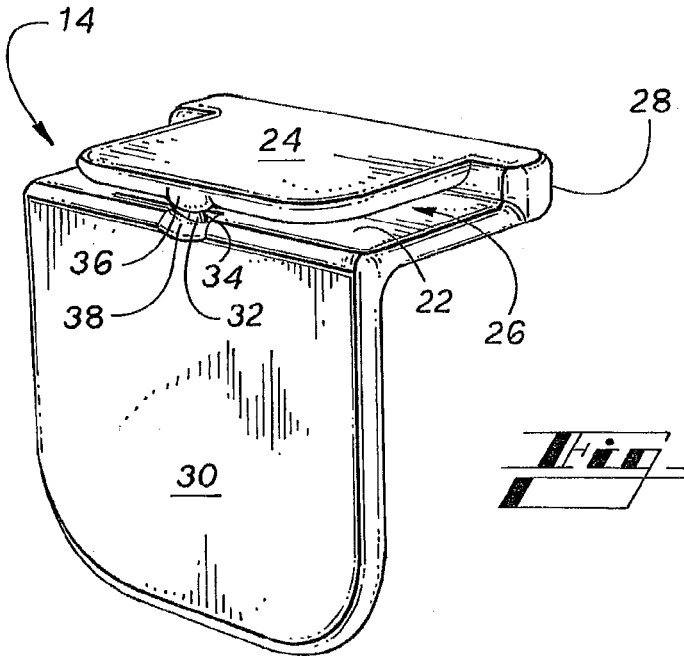
FIG. 2 is a perspective view of an exemplary embodiment of a cutting apparatus of a system for opening unit dose blister encasements, according to the present invention.

Referring now to FIG. 2, an exemplary embodiment of the cutting apparatus 14 of a system for opening an enclosed article is illustrated. The cutting apparatus 14 includes a first wall 22 and a second wall 24 that at least partially define a channel 26. In the exemplary embodiment, the walls 22, 24 are substantially parallel to one another and each of the walls 22, 24 extend from a base 28. A support wall 30 is substantially perpendicular to the first wall 22 and extends from the top end of the first wall 22. However, the orientation and relation between the support wall 30 and first wall 22 may change according to design needs.

The cutting apparatus 14 includes a cutting member 32. The cutting member 32 includes a cutting edge 34 and is substantially perpendicularly disposed in the channel 26. The cutting member 32 is positioned such that, as a unit dose blister 16 is translated through the channel 26, the cutting edge 34 engages the flanged portion 18 of the unit dose blister 16. In the exemplary embodiment, the cutting member 32 extends from the first wall 22 toward the second wall 24. A protrusion 36 extends from the second wall 24 toward the first wall 22. The protrusion 36 is positioned above, and substantially aligned with, the cutting member 32 in the channel 26. The protrusion 36 is sized, shaped, and positioned to protect and/or hide the cutting member 32. More specifically, the protrusion 36 is designed such that items translating between open ends of the channel 26, or items inserted in the top of the channel 26, are temporarily obstructed by the protrusion 36 until selectively translated or otherwise urged through the channel 26. A relief notch 38 is formed opposite the protrusion 36, preferably at the base of the cutting member 32. One function of the relief notch 38 is to receive and accommodate the protrusion 36.

For purposes of teaching, and not limitation, a method of attaching the cutting apparatus 14 to the container 12 to form an exemplary embodiment of a system for opening an enclosed article is now described. Referring to FIG. 1, a cutout 40 is formed in a corner of the container 12. The cutout 40 defines a flap 42. The cutting apparatus 14 can then be attached to the inside of the container 12 such that the channel 26 of the cutting apparatus 14 is accessible. More specifically, the second wall 24 aligns with, and is attached to, the inside of the flap 42. Additionally, the support wall 30 is attached to the inside of the top wall of the container 12. In some embodiments the flap 42 is eliminated and the cutting apparatus is attached with sidewalls (not shown), to the interior sidewalls of the container 12.

Figure 3:
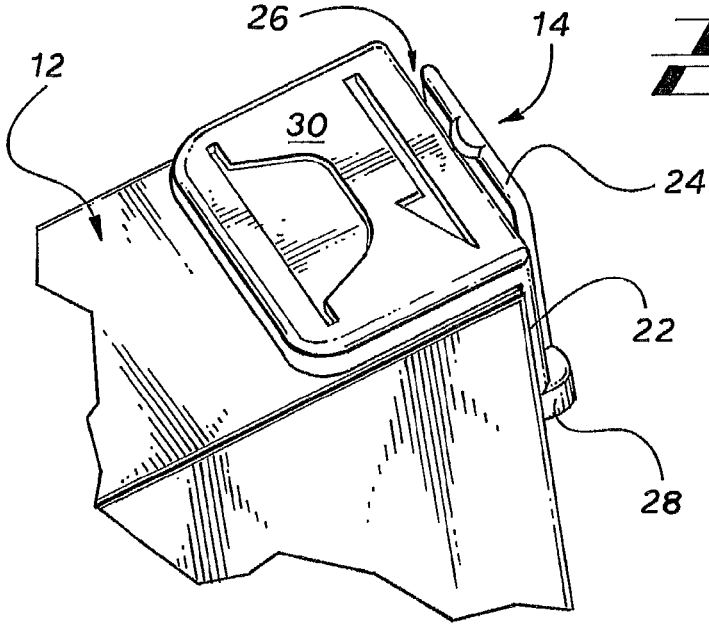
FIG. 3 is a perspective view of an exemplary embodiment of a system for opening unit dose blister encasements with a cutting apparatus mounted at an exterior corner of a container, according to the present invention.

In other exemplary embodiments, the cutting apparatus 14 can be attached to the outside of the container 12. The cutting apparatus 14 can be attached to any corner formed by two walls of the container 12. For example, as shown in FIG. 3, the cutting apparatus 14 is attached to a corner of the container 12 that is formed by an end wall and the top wall. More specifically, the support wall 30 of the cutting apparatus 14 may be attached to the top wall of the container 12, and the first wall 22 of the cutting apparatus 14 may be attached to the end wall of the container 12. The cutting apparatus 14 can be attached to the container 12 by any suitable means for attachment including tapes, adhesives, mechanical fasteners, Velcro®, and the like.

To access the contents of a unit dose blister 16, the flanged portion 18 is translated through the channel. As the flanged portion 18 is translated through the channel 26, the leading edge of the flanged portion 18 first engages the protrusion 36. The protrusion 36 is shaped such that, when the protrusion 36 is engaged by the leading edge of the flanged portion 18, the force against the protrusion 36 causes the second wall 24 to deflect. The second wall 24 flexes to allow the cutting member 32 to slit or puncture a blister backing and/or pouch. In the exemplary embodiment, the protrusion 36 moves to expose the cutting member 32 to the leading edge of the flanged portion 18. As the flanged portion 18 continues to translate through the channel 26, the flanged portion 18 is engaged by the cutting edge 34 of the cutting member 32 and the resistance of the second wall 24 holds the protrusion 36 against the flanged portion 18. After the trailing edge of the flanged portion 18 clears the cutting member 32, the elasticity of the second wall 24 returns the protrusion 36 to its substantially undeflected position. The cutting member 32 thereby cuts the blister substrate, or removes a section of the unit dose blister 16, such that the contents can be accessed. The cutting edge 34 is preferably positioned below the blister bubble 20, or so close to the perimeter of the blister bubble 20, such that the cutting edge 34 does not substantially project into the blister bubble 20. A user may increase pressure on the cutting member 32 by pressing on the second wall 24.

Figure 4:
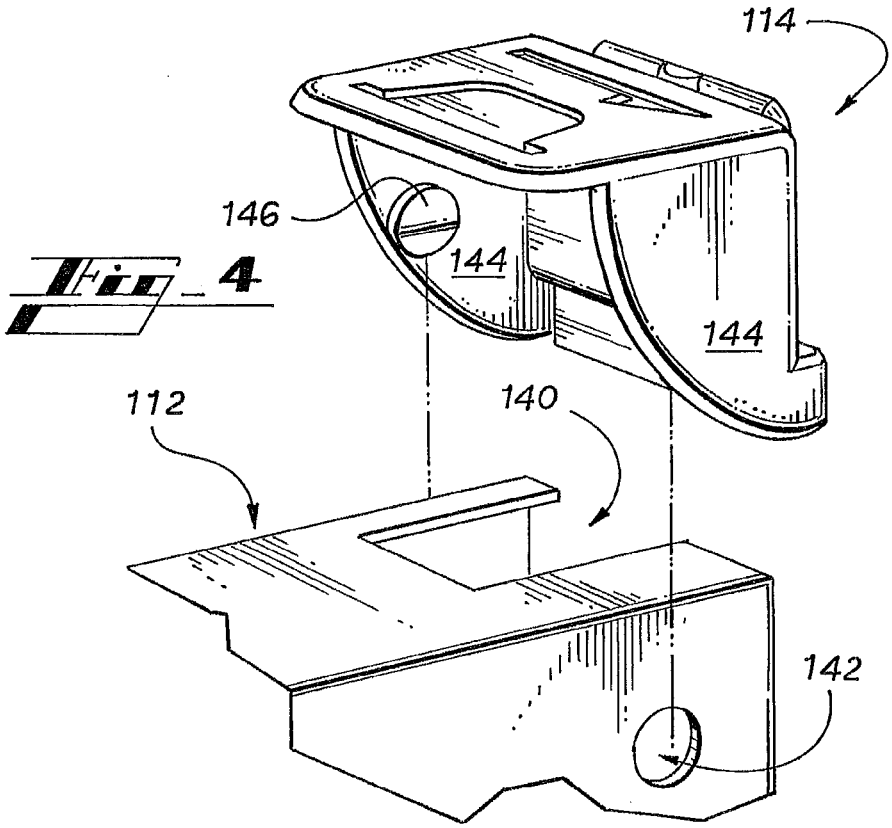
FIG. 4 is a perspective view of an exemplary embodiment of a system for opening unit dose blister encasements, with a cutting apparatus thereof positioned for juxtaposition with a container, according to the present invention.

In another exemplary embodiment shown in FIG. 4, a system includes additional elements that facilitate the attachment of a cutting apparatus 114 to a container 112. The container 112 includes a cutout 140 disposed in a corner of the container 112 and apertures 142 disposed in opposing side walls of the container 112. The cutting apparatus 114 includes side walls 144 and detents 146 that extend from the inside of the side walls 144. The cutting apparatus 114 is received in the cutout 140 of the container 112. Additionally, the cutting apparatus 114 is secured to the container 112 as the detents 146 are received in respective apertures 142.

Figure 5:
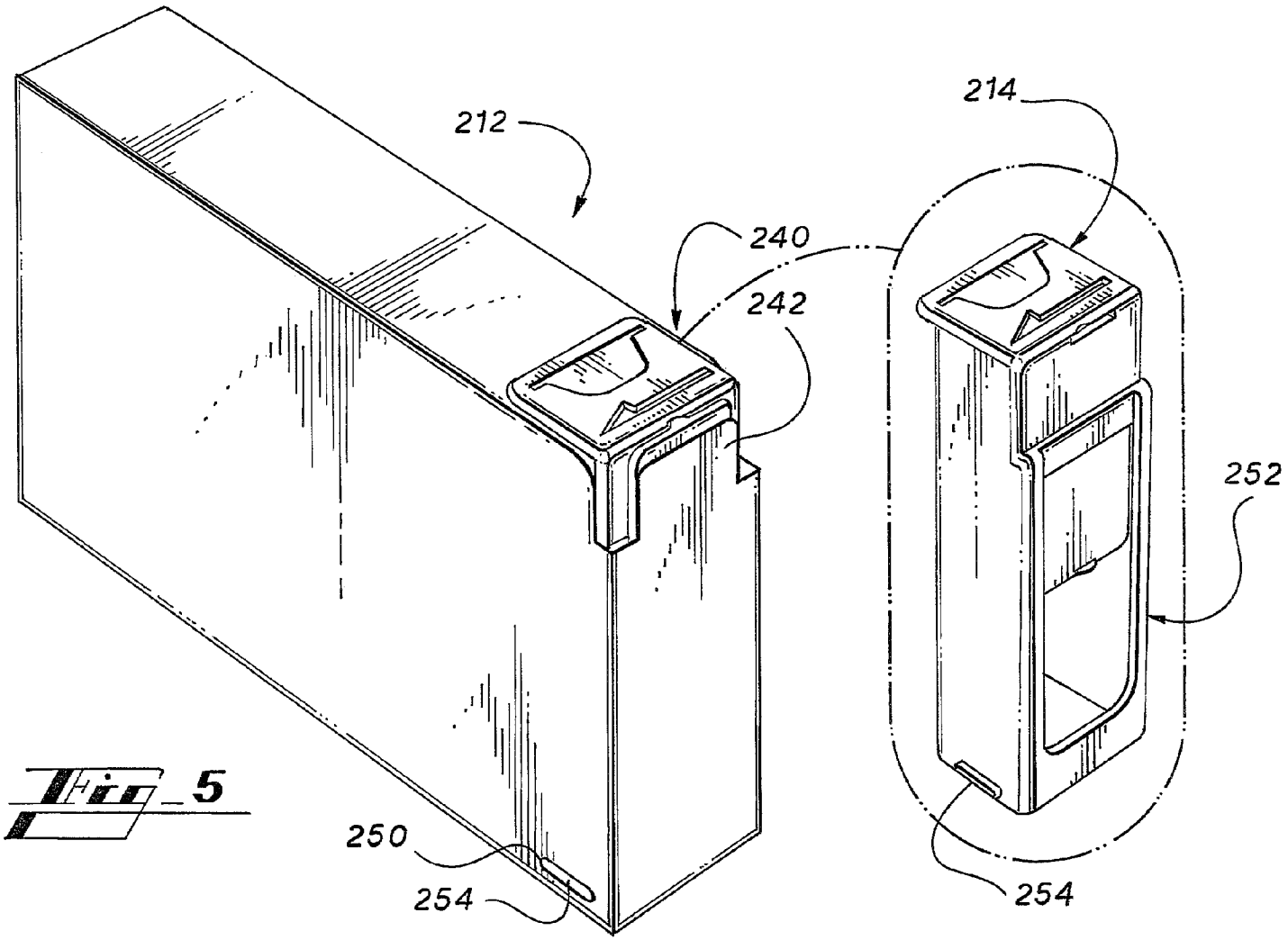
FIG. 5 is a perspective view of an exemplary embodiment of a system for opening unit dose blister encasements, with a cutting apparatus shown adjacent a container, according to the present invention.

In still another exemplary embodiment shown in FIG. 5, a system includes additional elements that facilitate the attachment of a cutting apparatus 214 to a container 212. The container 212 includes a cutout 240 that defines a flap 242. The container 212 further includes slots 250 in opposing walls that align with the cutout 240. The cutting apparatus 214 includes an insert structure 252 that is sized and shaped to be received in the container 212 through cutout 240, and that positions cutting apparatus 214 in the cutout 240. The insert structure 252 includes detents 254 that are designed to be received in respective slots 250. The cutting apparatus 214 can be secured to the container 212 by inserting the insert structure 252 in the cutout 240 until the detents 254 are received in the slots 250, thereby positioning the cutting apparatus 214 adjacent to the corner of the container 212. In some embodiments the cutting apparatus 214 is positioned along the center of the container 212, while in other embodiments the cutting apparatus 214 is positioned at other locations within the container 212.

Figure 6:
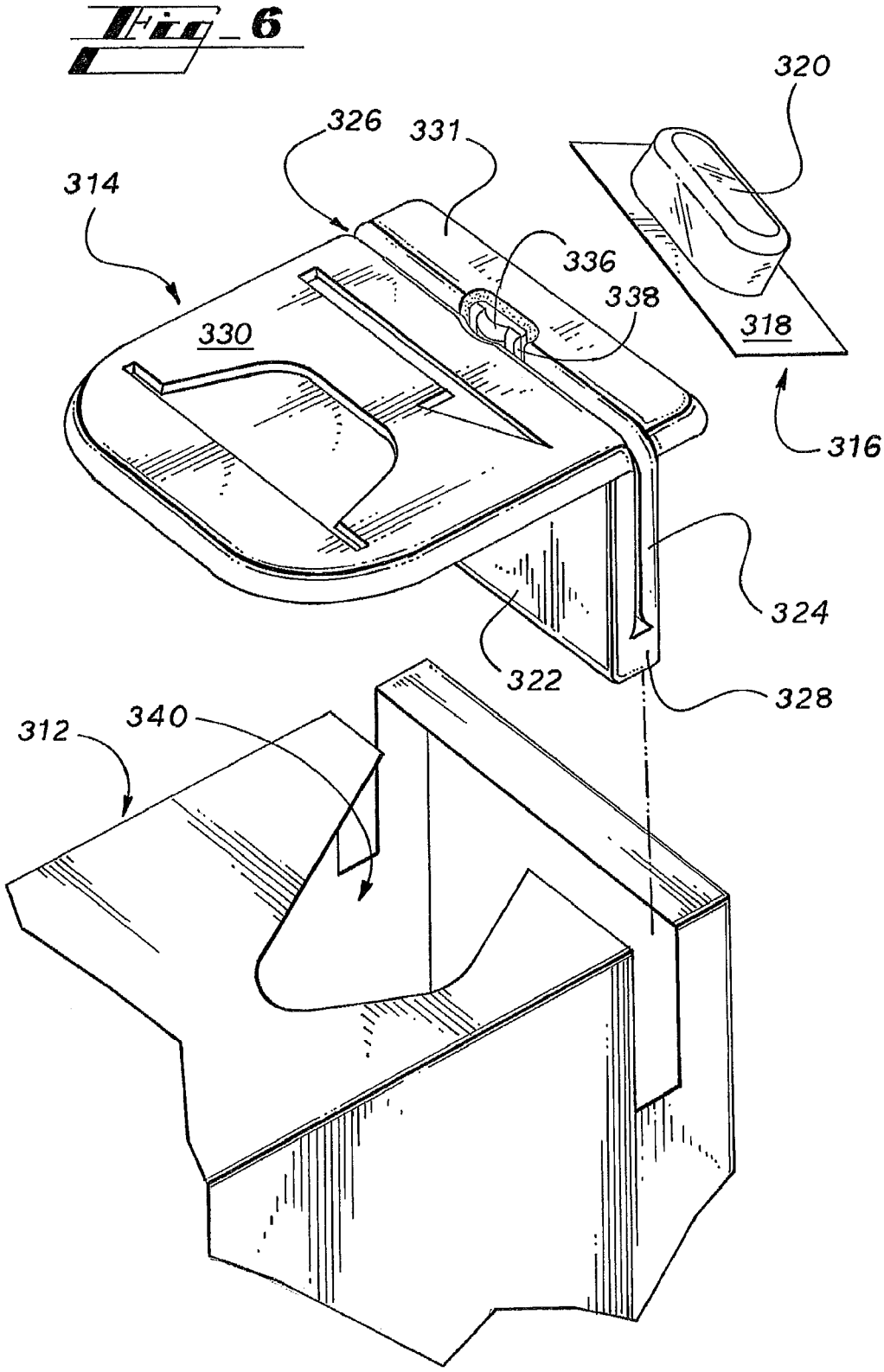
FIG. 6 is a perspective view of an exemplary embodiment of a system for opening unit dose blister encasements, with a cutting apparatus positioned for juxtaposition with a container, according to the present invention.

In a further exemplary embodiment shown in FIG. 6, a system includes a cutting apparatus 314 attached to a container 312. The cutting apparatus 314 includes a first wall 322 and a second wall 324 that at least partially define a channel 326. In this embodiment, the walls 322, 324 are substantially parallel to one another and each of the walls 322, 324 extend from a base 328. A first support wall 330 is substantially perpendicular to the first wall 322 and extends from the top end of the first wall 322. A second support wall 331 is substantially perpendicular to the second wall 324 and extends from the top end of the second wall 324.

The cutting apparatus 314 further includes a cutting member (not shown) that includes a cutting edge (not shown). The cutting member is disposed in the channel 326. The cutting member is positioned such that, as the illustrated unit dose blister 316 is translated through the channel 326, the cutting edge engages the flanged portion 318 of the unit dose blister 316. In the exemplary embodiment, the cutting member extends from the first wall 322 toward the second wall 324. A protrusion 336 extends from a cantilever 338, the cantilever 338 being defined by cuts in the second wall 324.

The protrusion 336 is positioned above, and substantially aligned with, the cutting member in the channel 326. The protrusion 336 is sized, shaped, and positioned to protect or hide the cutting member. More specifically, the protrusion 336 is designed such that items translating between open ends of the channel 326, or items inserted in the top of the channel 326, are obstructed by the protrusion 336.

For purposes of teaching, and not limitation, an exemplary embodiment of a method of attaching the cutting apparatus 314 to the container 312 is now described. Referring to FIG. 6, a cutout 340 is formed in the container 312 that is offset from a corner of the container 312. The cutting apparatus 314 is received in the cutout 340 and the support walls 330, 331 are attached to opposing sides of the cutout 340.

To access the contents of the illustrated unit dose blister 316, the flanged portion 318 is translated through the channel 326. The leading edge of the flanged portion 318 first engages the protrusion 336. The protrusion 336 is shaped such that, when the protrusion 336 is engaged by the leading edge of the flanged portion 318, the force against the protrusion 336 causes the cantilever 338 to deflect. Accordingly, the protrusion 336 moves to expose the cutting member to the leading edge of the flanged portion 318. As the flanged portion 318 continues to translate through the channel 326, the flanged portion 318 is engaged by the cutting edge of the cutting member and the elastic resistance of the cantilever 338 holds the protrusion 336 against the flanged portion 318. After the trailing edge of the flanged portion 318 clears the cutting member, the elasticity of the cantilever 338 returns the protrusion 336 to its substantially undeflected position. The cutting member thereby cuts the blister substrate or removes a section of the unit dose blister 316 such that the contents can be accessed. The cutting edge is preferably positioned below blister bubble 320, or close to the perimeter of the blister bubble 320, such that the cutting edge does not substantially project into the blister bubble 320.

Figure 7:
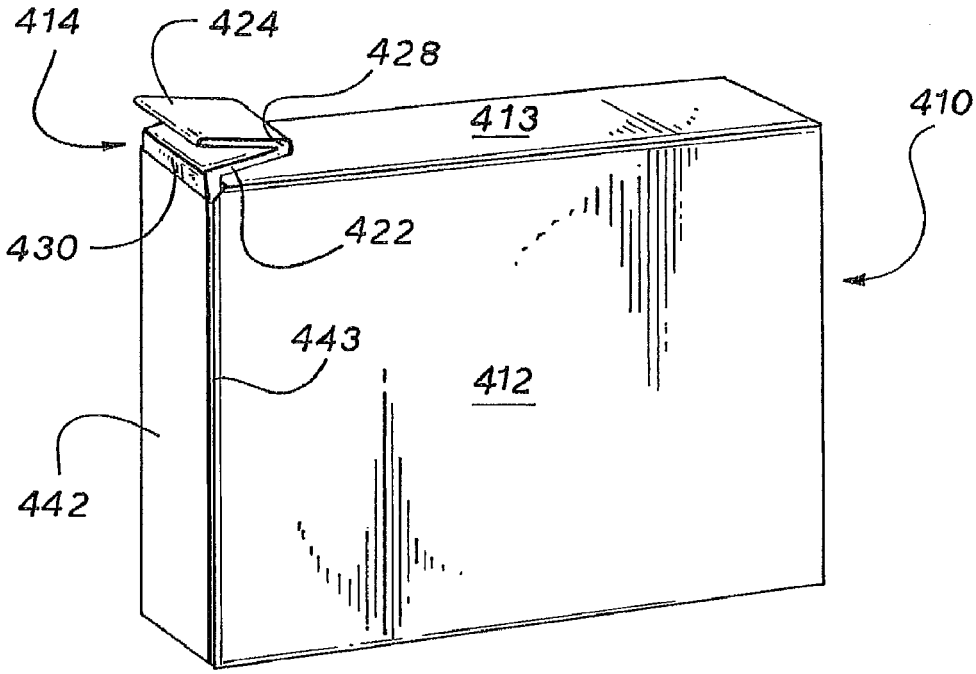
FIG. 7 is a perspective view of an exemplary embodiment of a system for opening unit dose blister encasements, with a cutting apparatus fully juxtaposed in place with a container, according to the present invention.

In a still further exemplary embodiment of a system 410 for opening an encased article, shown in FIG. 7, the support wall 430 of a cutting apparatus 414 as described herein can be inserted, press fit, or otherwise attached between the end flaps 442, 443 of a container 412. When the support wall 430 is inserted between the flaps 442, 443 of a container 412, a wedge-shaped space is defined between the container 412 and the first wall 422 of the cutting apparatus 414. The first wall 422 extends from the insertion area of the container 412, where the support wall 430 is inserted between edge flaps 442, 443 of the container 412, at an angle relative to a wall of the container 412. The base 428 of the cutting apparatus 414 is thus set apart from the adjacent wall 413 (a top wall in the view illustrated) of the container 412. In this embodiment, a user can press on the base 428 of the cutting apparatus 414 to flex the first 422 and second 424 walls such that the walls separate to increase the width of the channel opening. As the second wall 424 separates from the first wall 422, the cutting member (not fully shown) is at least partially exposed, and the channel is widened to allow a unit dose blister or pouch to easily pass through the channel. It should be noted that a protrusion (not fully shown) extending from one of the first and second walls of the cutting apparatus 414 at least partially shields the cutting member in this exemplary embodiment also.

Also, in this embodiment, the second wall 424 and base 428 of the cutting apparatus 414 can be pressed by a user to provide additional functionality other than that of passively flexing the second wall. For example, the user can press the center area of the second wall, as a unit dose blister or pouch is translated through the channel, to apply pressure that forces the cutting edge deeper through the blister or pouch. The cutting edge can be used for cutting or puncturing the unit dose blister or pouch. To puncture a unit dose blister or pouch, the unit dose blister or pouch can be placed in the channel of the cutting apparatus between the cutting member and the second wall. The second wall can then be pushed toward the first wall such that the edge of the cutting member punctures the backing or flanged portion of the unit dose blister or pouch.

Figure 8:
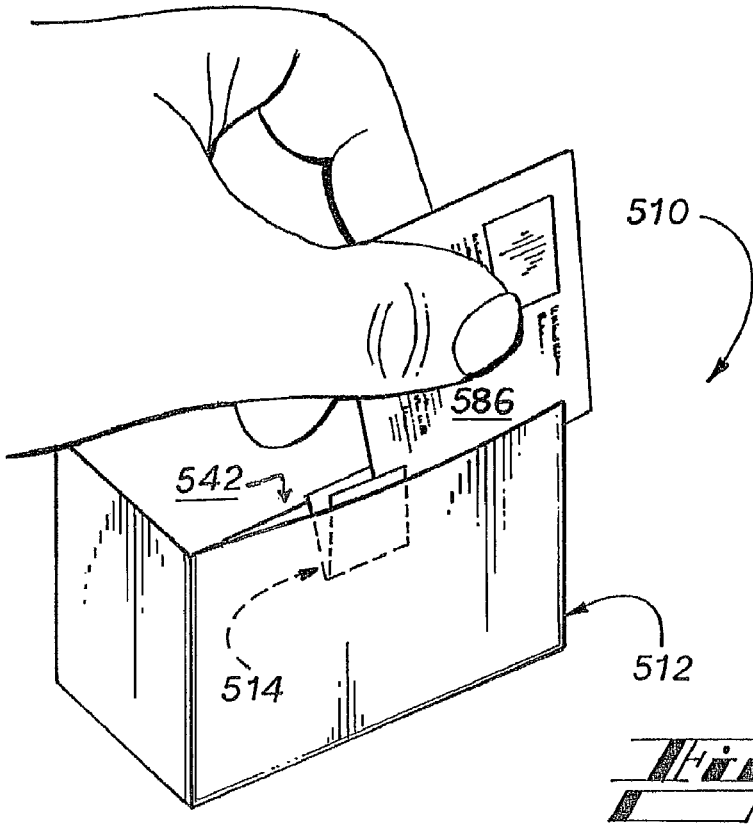
FIG. 8 is a perspective view of an exemplary embodiment of a system for opening unit dose blister encasements, with a cutting apparatus fully juxtaposed in place with a container, according to the present invention.

In yet a further exemplary embodiment of a system 510 for opening encased articles shown in FIG. 8, a cutting apparatus 514 as described herein can be attached to a container 512 such that the channel of the cutting apparatus is accessible in a space under a flap 542 of the container 512. This embodiment is particularly useful for cutting or slicing pouches 586 (as illustrated in FIG. 8) that hold items to be accessed. Further, the cutting apparatus 514 described herein may be configured to be removable from the container 512, which can provide additional child resistance.

The law does not require and it is economically prohibitive to illustrate and teach every possible embodiment of the present claims. Hence, the above-described embodiments are merely exemplary illustrations of implementations set forth for a clear understanding of the principles of the invention. Variations, modifications, and combinations may be made to the above-described embodiments without departing from the scope of the claims. All such variations, modifications, and combinations are included herein by the scope of this disclosure and the following claims.

What is claimed is:

1. A system for opening an encased article, the system comprising:

a container for storing at least one encased article, and a cutting apparatus conjoined with said container, the cutting apparatus including:

a channel defined by a first wall spaced apart from a substantially parallel second wall; and a cutting member having a cutting edge, attached to one of said first wall and said second wall and disposed in said channel, wherein said cutting apparatus is received at least in part in said container such that said channel is disposed substantially inside said container, said container having a cutout formed therein such that opposed open ends of said channel are exposed through said cutout to allow said channel to be accessible exteriorly of said container.

2. A system for opening an encased article, the system comprising:

a container for storing at least one encased article, and a cutting apparatus conjoined with said container, the cutting apparatus including:

a channel defined by a first wall spaced apart from a substantially parallel second wall; and a cutting member having a cutting edge, attached to one of said first wall and said second wall and disposed in said channel, wherein said cutting apparatus is received at least in part in said container such that said channel is disposed substantially inside said container, said container having a cutout formed therein such that opposed open ends of said channel are exposed through said cutout to allow said channel to be accessible exteriorly of said container, wherein said cutting apparatus further includes at least one support wall extending from a respective one of said first wall and said second wall to engage with said container.

3. The system of claim 2, wherein said support wall is substantially perpendicular to said respective one of said first wall and said second wall from which said support wall extends.

4. The system of claim 2, wherein said support wall is adhered to an inside of said container.

5. The system of claim 2, wherein said cutting apparatus is fixed at a corner region of said container.

6. The system of claim 5, wherein said cutting apparatus lies substantially within said container.

7. The system of claim 2, wherein said cutting apparatus further includes a protrusion disposed in said channel opposite said cutting member.

8. The system of claim 7, wherein said protrusion depends from the other of said first wall and said second wall opposite said one of said first wall and said second wall to which said cutting member is attached.

9. The system of claim 8, wherein said cutting apparatus further includes a relief notch for receiving said protrusion.

10. The system of claim 9, wherein said relief notch is disposed proximate a base of said cutting member.

11. The system of claim 7, wherein said protrusion is transversely translatable substantially perpendicularly with respect to said channel.

12. The system of claim 2, wherein said cutout is positioned proximate a corner of said container defined by two adjacent walls of said container, wherein said cutting apparatus is attached to respective inside surfaces of said adjacent walls such that said channel is substantially aligned with said cutout.

13. The system of claim 12, wherein said cutout defines a flap formed from part of one of said adjacent walls of said container, and one of said first and second walls of the cutting apparatus is attached to an inside surface of said flap.

14. The system of claim 13, wherein said cutout extends across at least one of said adjacent walls of said container to define a free end edge of said flap.

15. A system for opening an encased article, the system comprising:

a container for storing at least one encased article, and a cutting apparatus conjoined with said container, the cutting apparatus including:

a pair of first and second substantially parallel walls that defines a channel therebetween; and a cutting member attached to one of said first and second walls and disposed in said channel, wherein said cutting apparatus is received at least in part in said container such that said channel is disposed substantially inside said container, wherein said container has a cutout proximate a corner of said container defined by two adjacent walls of said container, wherein said cutting apparatus is attached to respective inside surfaces of said adjacent walls such that said channel is substantially aligned with said cutout so as to be accessible from an outside of said container.

16. The system of claim 15, wherein said cutout defines a flap formed from part of one of said adjacent walls of said container, and one of said first and second walls of the cutting apparatus is attached to an inside surface of said flap.

17. The system of claim 16 wherein said cutout extends across at least one of said adjacent walls of said container to define a free end edge of said flap.

18. The system of claim 17 wherein said cutout further extends along opposed side edges of said flap so that opposed open end of said channel are exposed through said cutout.

* * * * *